US008066259B2

(12) United States Patent
Fang et al.

(10) Patent No.: US 8,066,259 B2
(45) Date of Patent: Nov. 29, 2011

(54) HYDRAULIC JACK WITH LOWERING CONTROL MEANS

(75) Inventors: Xiang Fang, Taishan (CN); Allen Shouyun Zhang, Chino Hills, CA (US)

(73) Assignee: Larin Corporation, Ontario, CA (US)

( * ) Notice: Subject to any disclaimer, the term of this patent is extended or adjusted under 35 U.S.C. 154(b) by 1149 days.

(21) Appl. No.: 11/538,551

(22) Filed: Oct. 4, 2006

(65) Prior Publication Data

US 2008/0083913 A1 Apr. 10, 2008

(51) Int. Cl.
*B66F 5/04* (2006.01)

(52) U.S. Cl. ..... 254/8 B; 254/2 B; 254/93 R; 254/89 H

(58) Field of Classification Search ..... 254/8 B, 254/1, 2 B, 93 R, 89 H, 93 H, 120, 9 B, 3 B, 254/7 B, 131
See application file for complete search history.

(56) References Cited

U.S. PATENT DOCUMENTS

| | | | | |
|---|---|---|---|---|
| 2,114,788 | A * | 4/1938 | Tibbetts | 74/531 |
| 4,289,299 | A * | 9/1981 | Kameda | 254/8 B |
| 4,505,167 | A * | 3/1985 | Nicolaus | 74/577 R |
| 5,221,073 | A * | 6/1993 | Shockley | 254/8 B |
| 5,618,029 | A * | 4/1997 | Chung | 254/8 B |
| 6,685,177 | B2 * | 2/2004 | Dugas et al. | 269/32 |

* cited by examiner

*Primary Examiner* — Lee D Wilson
(74) *Attorney, Agent, or Firm* — Greenberg Traurig LLP

(57) ABSTRACT

A hydraulic jack comprising a hydraulically actuated saddle movable from a first lowered position to a second raised position, the jack having a handle which, when pumped up and down, hydraulically raises the saddle, lowering control means associated with the jack for preventing premature lowering of the saddle upon malfunction of the hydraulic actuation during raising of the saddle and a release lever engaging the lowering control means adapted to release the same and permit lowering of the saddle when the handle is pumped up and down.

7 Claims, 7 Drawing Sheets

HYDRAULIC JACK WITH LOWERING CONTROL MEANS

BACKGROUND

1. Field

This disclosure relates to relates to hydraulic jacks; and, more particularly, to hydraulic jacks that are used to raise and lower loads.

2. General Background

Hydraulic jacks used to raise and lower loads are well known in the art. Such jacks are usually rolled or otherwise placed under a load that it is desired to lift, such as a vehicle, then a lever is activated to raise the saddle of the jack that engages the load placed thereon. When it is desired to lower the load, the lever is used to release the jack and lower the saddle and thus the load placed thereon. However, should the hydraulic mechanism used to raise and lower the jack malfunction, then the jack may drop the load too quickly possibly resulting in injury to the operator.

There is need for an hydraulic jack that has lowering control means for preventing the jack from being lowered out of control while lifting the load placed thereon due to malfunction or the like.

SUMMARY

It is an object of this invention to provide a hydraulic jack having means for controlling the lowering of the jack during lifting in case of a malfunction or the like.

It is a further object of this invention to carry out the foregoing objects wherein the means for controlling lowering of the jack during lifting includes a mechanism built into the spaced side plates of the jack.

These and other objects are preferably accomplished by providing a hydraulically activated jack having a pair of spaced interconnected side plates, a lift arm assembly pivotally mounted between the side plates, and a saddle mounted at top of the lift arm assembly adapted to be placed under the load to be lifted. The jack includes an hydraulically activated power assembly coupled to the lift assembly for raising and lowering the same. Means for limiting the lowering of the jack during lifting of the lift assembly is provided.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DESCRIPTION OF THE PREFERRED EMBODIMENT

Figure 1:
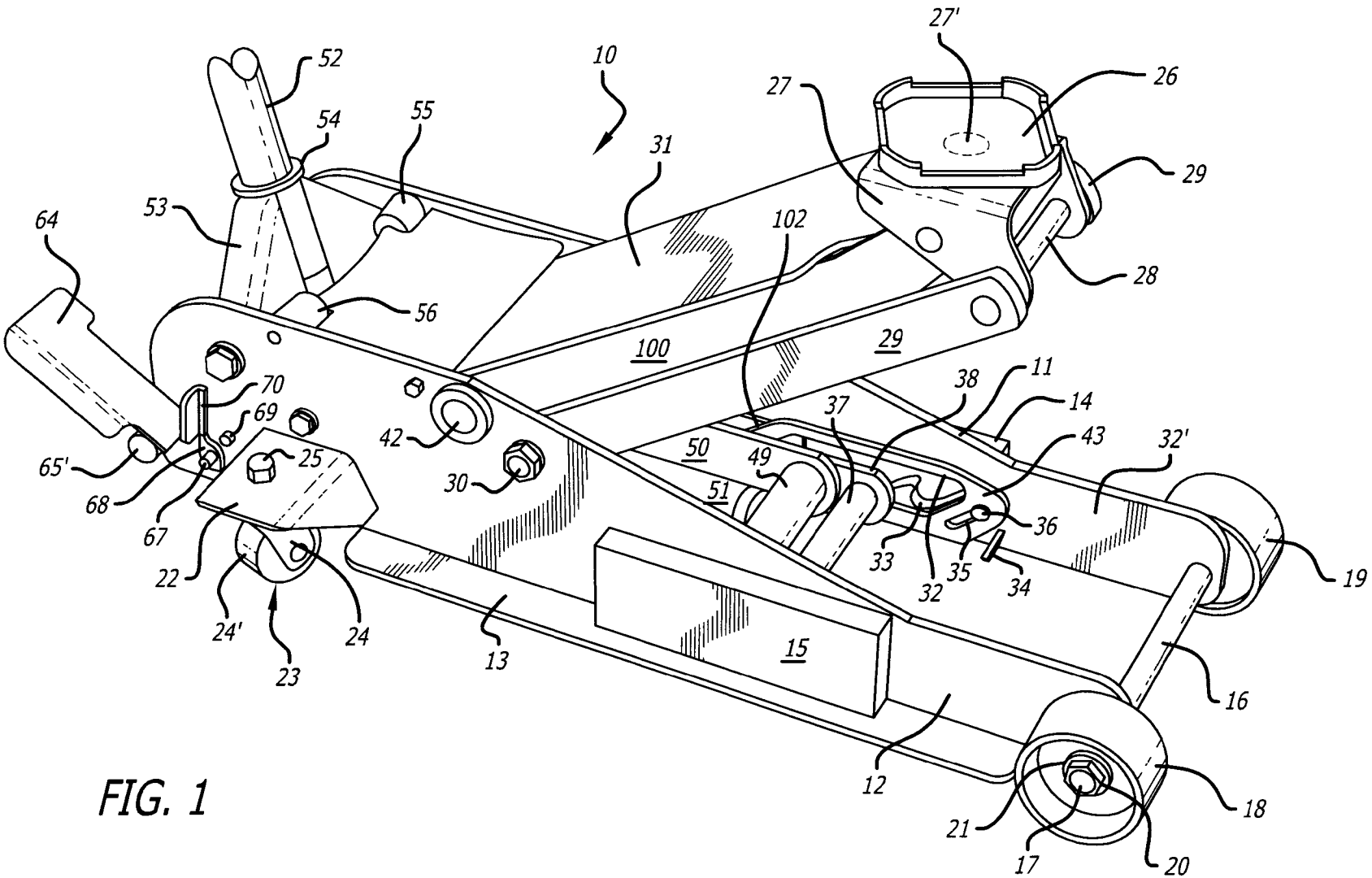
FIG. 1 is perspective view of a jack in accordance with the teachings of the invention.

A jack 10 in accordance with the teachings of the invention is shown in FIG. 1. Jack 10 has a pair of spaced side plates 11, 12 with integral outwardly extending flanges 13 on each side plate 11, 12 (only plate 13 on side plate 12 shown in FIG. 1). Block members 14, 15 may be provided on the outside of each side of plate 11, 12 to add weight and stability to jack 10.

Front axle 16 extends between plates 11, 12 terminating on the outside of plates 11, 12 in roller ends 17 having wheels 18, 19 rotatably mounted thereon as is well known in the art. Ends 17 are threaded at their terminal ends receiving a suitable nut 20 and washer 21 thereon to retain the wheels 18, 19 in place.

A pair of L-shaped flanges 22 are provided on side plates 11, 12 at the rear of jack 10. Each flange 22 holds a castor housing 23 comprised of a downwardly extending U-shaped yoke 24 having a wheel 24' secured to housing 23 by a nut 25.

A saddle 26 is rotatably mounted to a U-shaped flange 27 in any suitable manner, as, for example, by a downwardly extending pin 27' (shown in dotted lines) fixed on the bottom of saddle 27 loosely and rotatably mounted in a saddle receiver hole 26' (shown in dotted lines in FIG. 2) in flange 27.

Flange 27 is fixedly mounted to a pin 28 extending between a pair of spaced guide links 29. Links 29 are rotatably mounted at the rear on bolts 30 extending through each side wall 11, 12.

A lift arm assembly 31 having spaced downwardly extending side plates 100 is mounted between links 29 pivotally secured at one end to flange 27 and pivotally mounted by means of pin 42 to plates 11, 12.

A guide flange plate 43 is mounted on the inner wall 32 of each side wall 11, 12. Guide flange plate 43 has an elongated opening 32 therein aligned with a series of grooves 33 formed on inner wall 32'. A stop 34 is provided on the inner wall 32'. Flange plate 43 has an elongated slot 35 with a pin 36 extending from wall 32' riding therein. Pin 36 may be spring biased, if desired. A roller 37 is mounted between a pair of spaced links 38 with a pin portion 39 (FIG. 2), extending from roller 37, riding in grooves 33 as will be discussed. Links 38 are rotatably mounted on pin 40 at their rear ends.

A release plate 101 (FIG. 2) has spaced grooves 45, 46 receiving pins 47, 48, respectively, thereon. Release plate 102 has a rearwardly extending extension portion 83 A cylindrical member 49 (FIG. 1) is mounted between spaced links 50 (only one visible in FIG. 1) which links 50 are mounted at the rear to pin 40.

As is well known in the jack art, a conventional hydraulic cylinder 51 is fixed to cylindrical member 49 and moves the same back and forth when cylinder 51 is activated.

Cylindrical member 49 may be spring biased, if desired, in any suitable manner so as to return the same to the initial starting position.

Hydraulic cylinder 51 is activated by means of a handle 52 removably mounted in a handle housing 53 mounted at the front of jack 10 having a socket 54 receiving handle 52 therein. Handle housing 53 is rotatably mounted in any suitable manner and may abut against resilient spacer rollers 55, 56 mounted between side plates 11, 12.

It is to be understood that jack 10 includes a conventional power unit assembly (not shown) of which hydraulic cylinder 51 is a part thereof. Handle 52, at its lower end, engages the power unit assembly to move cylinder 49 back and forth when pumped up and down. That is, turning handle 52 clockwise and pumping handle 52 raises the saddle 26. Turning handle 52 counterclockwise lowers saddle 26, as will be discussed.

Figure 2:
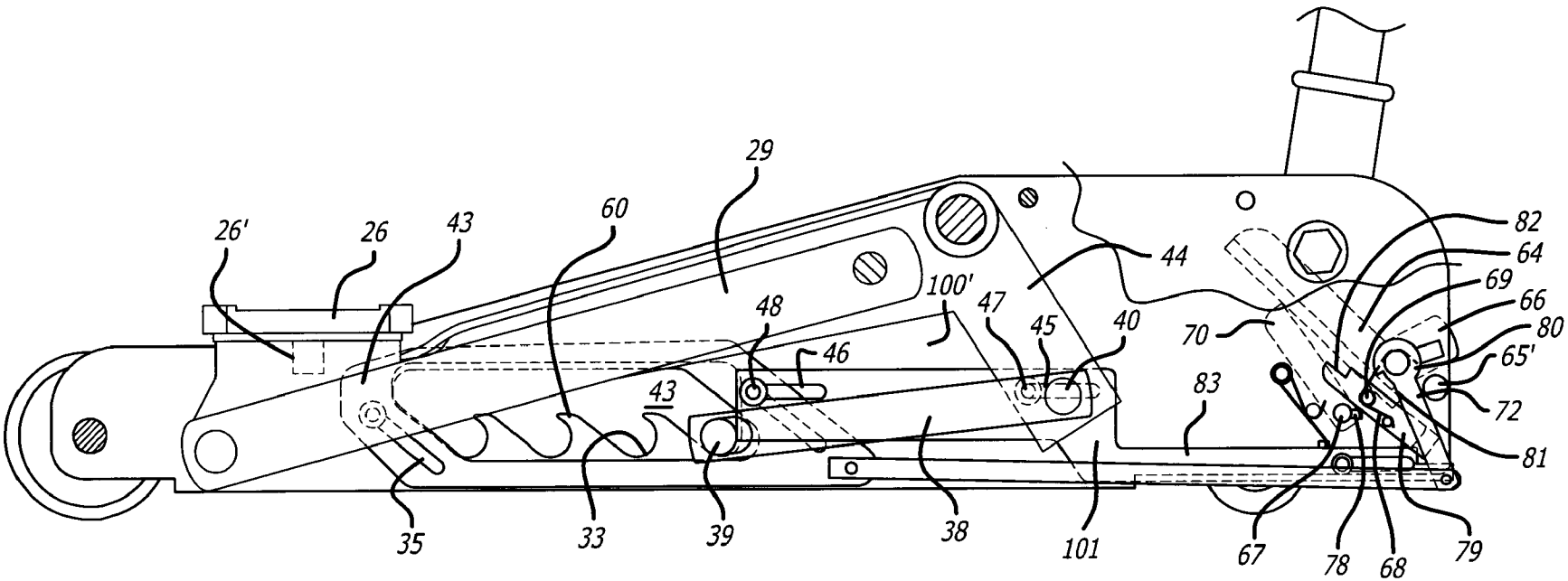
FIG. 2 is a side view, partly in section, illustrating the inner mechanism of the jack of FIG. 1.
Figure 3:
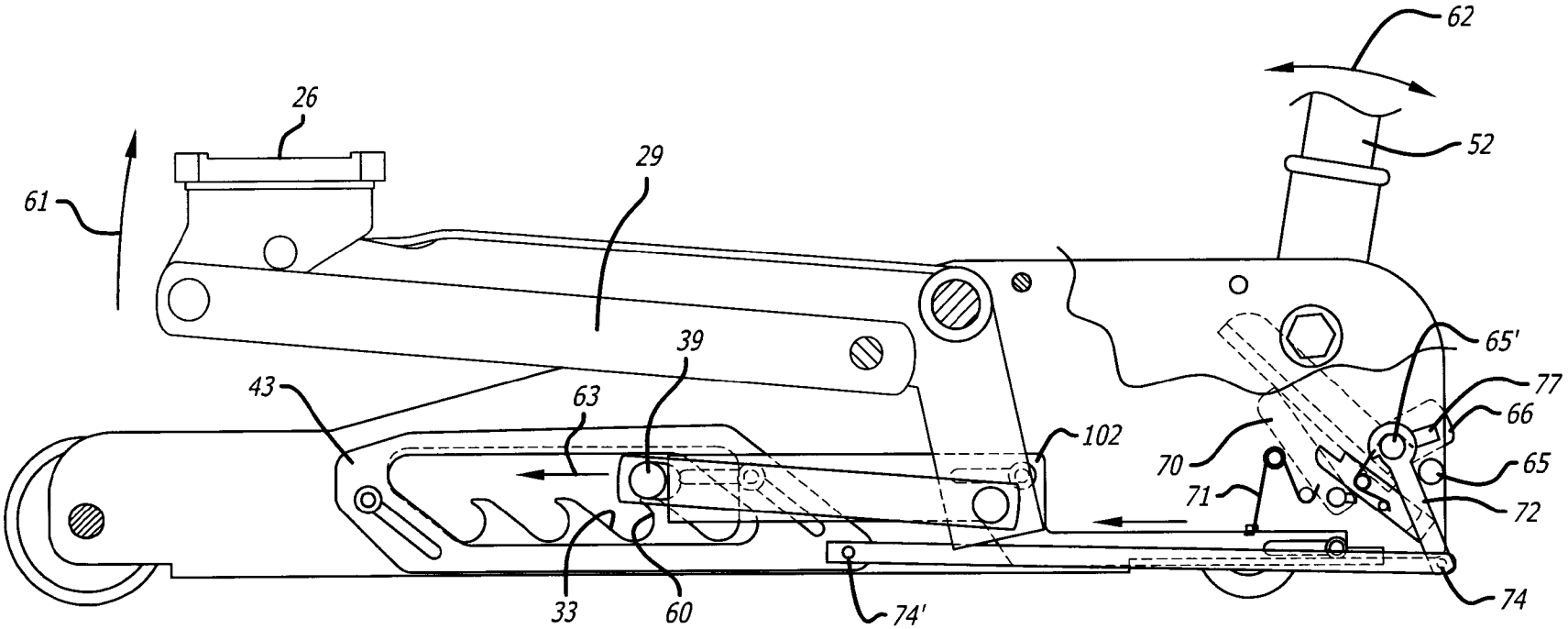
FIGS. 3 to 7 are views similar to FIG. 2 showing further steps in the operation of the jack of FIG. 1.
Figure 4:
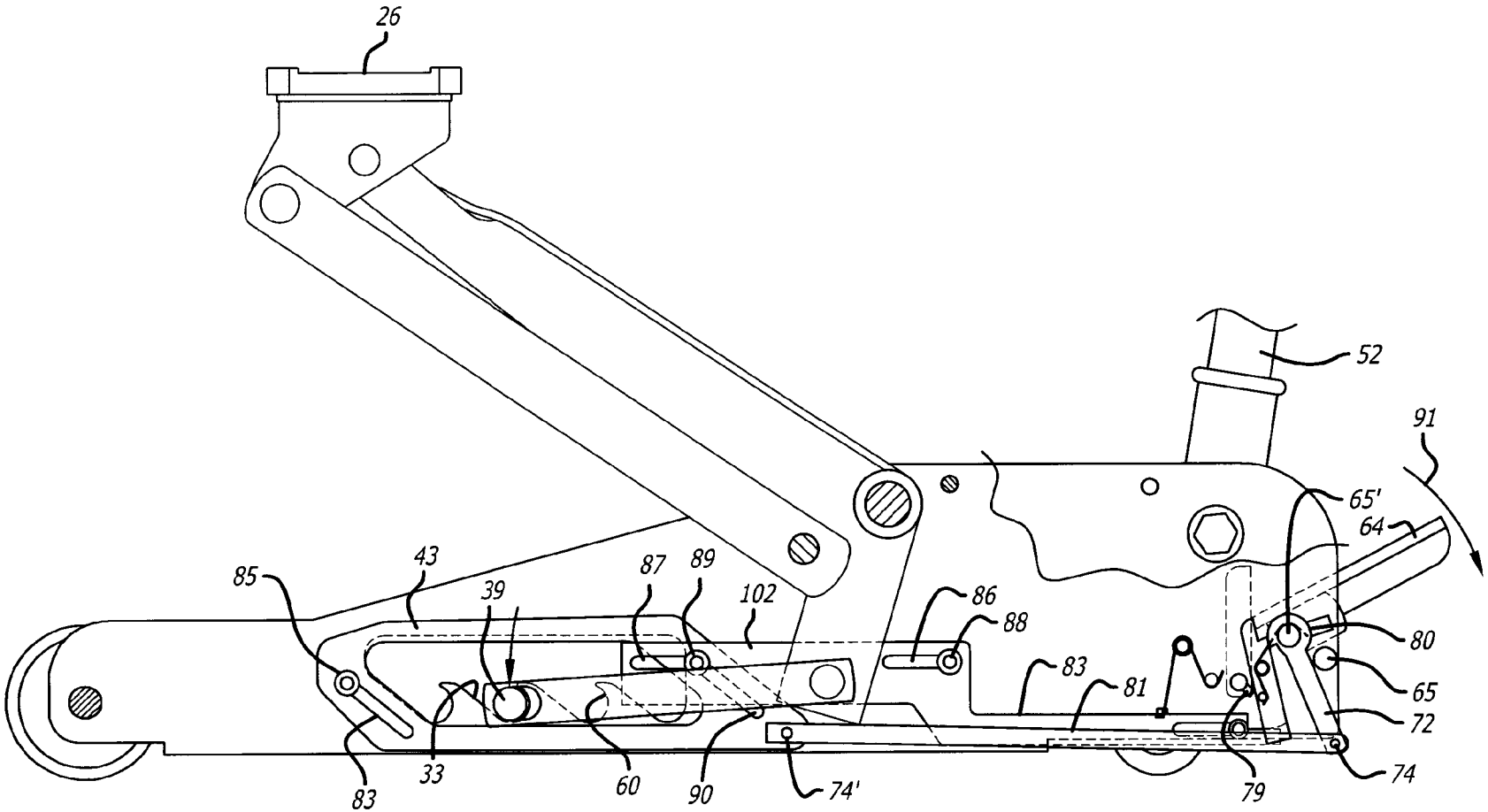

As the saddle 26 is lifted, starting from the FIG. 2 position, roller 39 rolls along plate 43 up over the ridges 60 into a respective groove 33. Thus, saddle 26, shown in the rest or down position in FIG. 2, moves upwardly in the direction of arrow 61 in FIG. 3 as handle 52 is moved up and down as indicated by arrow 62. Roller 39 is shown as rolling in the direction of arrow 63 over ridge 60 and is shown as about to enter a groove 33. The final "up" position for saddle 26 is shown with roller 39 disposed in one of the forward grooves 33 (FIG. 4).

It should be understood that the rollers 39 entering sequential grooves 33 as handle 52 is activated prevent the saddle 26 from falling prematurely if there is a failure in the power lift system possibly damaging the operator or equipment being lifted.

In order to release roller 39 from groove 33, a quick release lever 64 is provided. Lever 64 (FIG. 1) is rotatably mounted on a shaft 65' extending between side plates 11, 12. Lever 64 is stopped in its forward movement by engagement with a spring biased stop plate 66 (FIG. 2) rotatably mounted on shaft 67 which extends between side plates 11, 12. Plate 66 is spring biased by coil spring 68 engaging the bottom of lever 64 encircling pin 69 (FIG. 2) mounted on side plate 12. A release latch 70 (see FIG. 3) is mounted to side plate 12 biased by coil spring 71 (see also FIG. 5). Shaft 65' has a downwardly extending extension portion 72 (see also FIG. 6) on each end adjacent the inner walls 32' of each side plate 11, 12. Link 81 is pivotally connected at 74' to the lower end of each plate 43 and extends to and is fixed to extension portion 72 at point 74. As will be discussed, pulling link 81 in the direction of arrow 75 (FIG. 6) pulls plates 43 rearwardly in the direction of arrow 75. A suitable stop 65 may be provided on the inner wall 32' engaged by an extension 77 on extension portion 72.

When plate 66 is rotated, it rotates shaft 65', extending between side walls 11, 12.

Release lever 70 rotates shaft 67 (FIG. 2) which is spaced from shaft 65' and has an extension portion 78 (FIG. 2) adapted to engage release spring biased lever 79 when activated. Lever 79 abuts at one end against hub 80 (FIG. 2) of extension portion 72 having a shoulder 81 thereon. Lever 79 is notched at notch 82 to hold hub 80 in locked position and thus hold guide flange plates 43 in position. When released, notch 82 disengages from shoulder 81 moving the lower end of lever 79 (FIG. 5) against link 83 which has a guide slot 84 therein with pin 83 movable therein. Links 83 extend from plates 102 and are adapted to lift plates 43 upwardly along with pins 39 when lever 79 is released, thus lifting rollers 39 out of slots 33. Link 83 (FIG. 4) also has spaced guide slots 86, 87 with pins 88, 89, respectively, adapted to ride thereon. Pin 89 also moves along slots 90 in plates 43.

Figure 6:
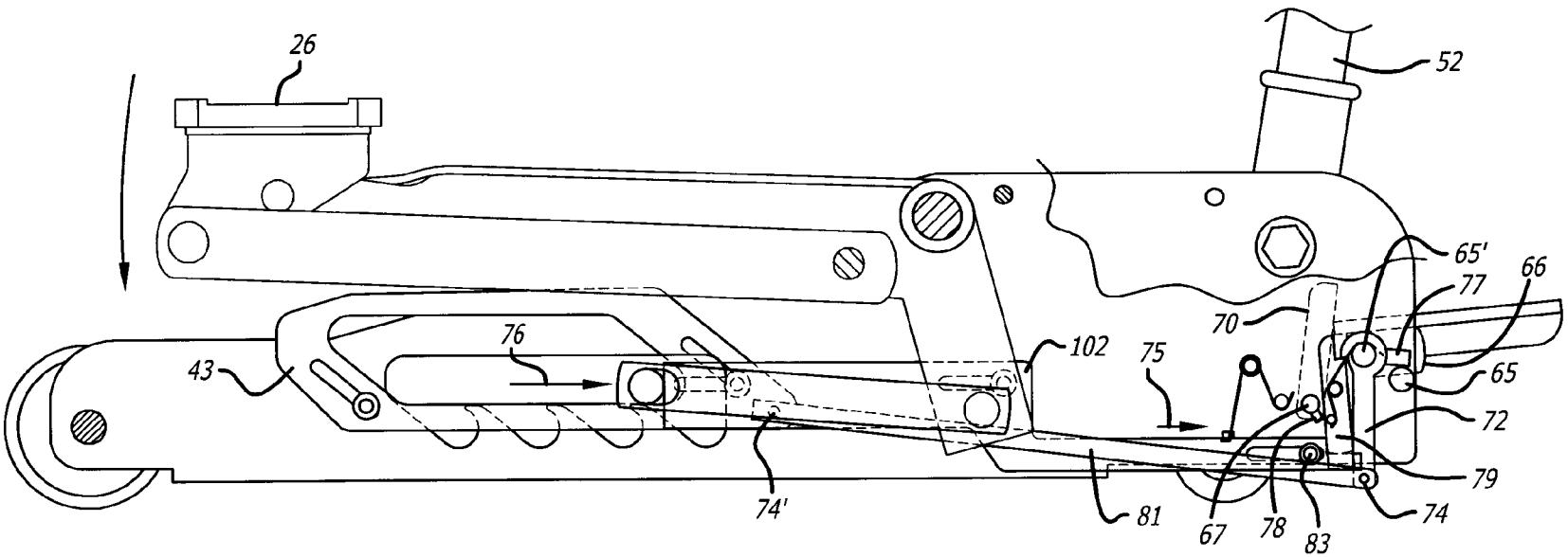
Figure 7:
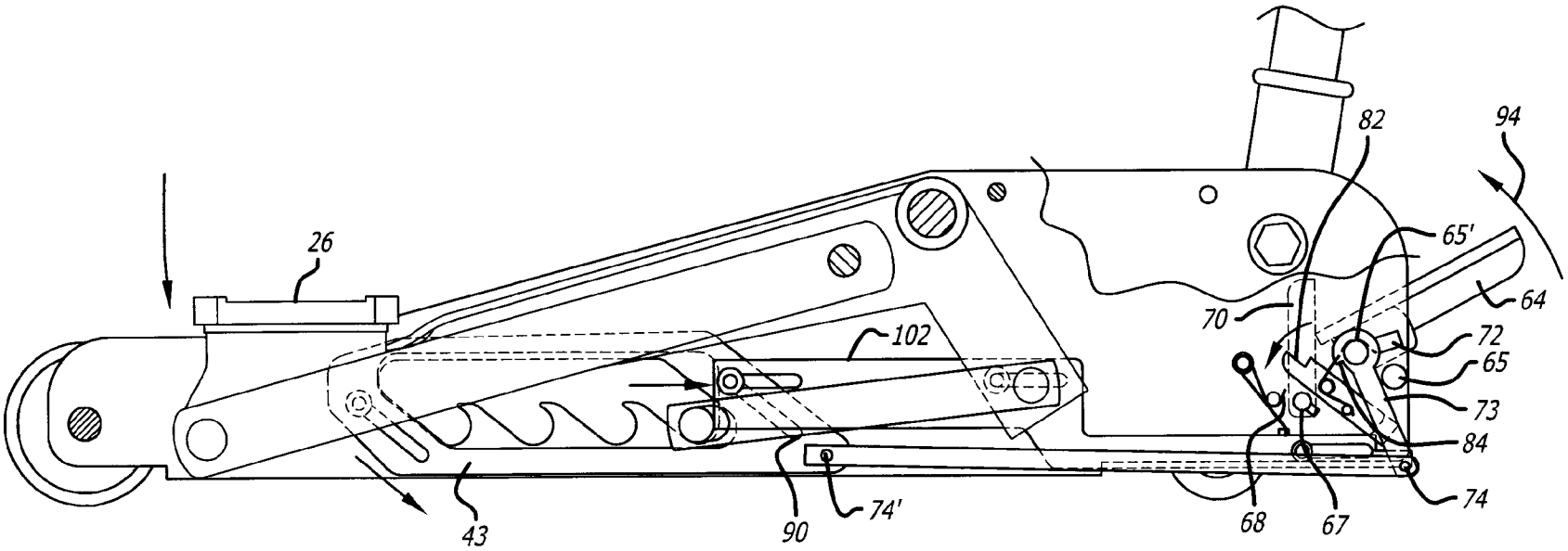

Thus, in operation, handle 52 is rotated clockwise, as previously discussed, and handle 52 is pumped to raise the jack. At this stage, release lever 64 is in the forward or FIG. 2 position. This is also the stored position of lever 64, safely out of the way. As previously discussed, rollers 39 move from the FIG. 2 to the FIG. 3, then to the FIG. 4 position. Lever 64 is then moved rearwardly in the direction of arrow 91 (FIG. 4) and pressed downwardly again in the direction of arrow 91. As can be appreciated by comparing FIG. 2 to 4, as lever 64 is moved in the direction of arrow 91, the lower end of extension portion 78 abuts against the rear end of link 83 moving plates 43 forwardly and raising the same. That is, plates 43 are raised upwardly as indicated by arrow 93 in FIG. 5 thus also moving rollers 39 out of grooves 33. As rollers 39 moves rearwardly in the direction of arrow 76 (FIG. 6), saddle 26 moves downwardly and rollers 39 move along guide slot 32. The final position is shown in FIG. 7 and lever 64 can now be raised in the direction of arrow 94 back to the rear or stored position releasing 82 from engagement with shoulder 84 thus returning guide plates 43 to the position shown. Notch 82 thus engages the shoulder 84 in hub 80 holding the hub 80, and thus spring biased lever 64, in the FIG. 4 position prior to release.

Figure 5:
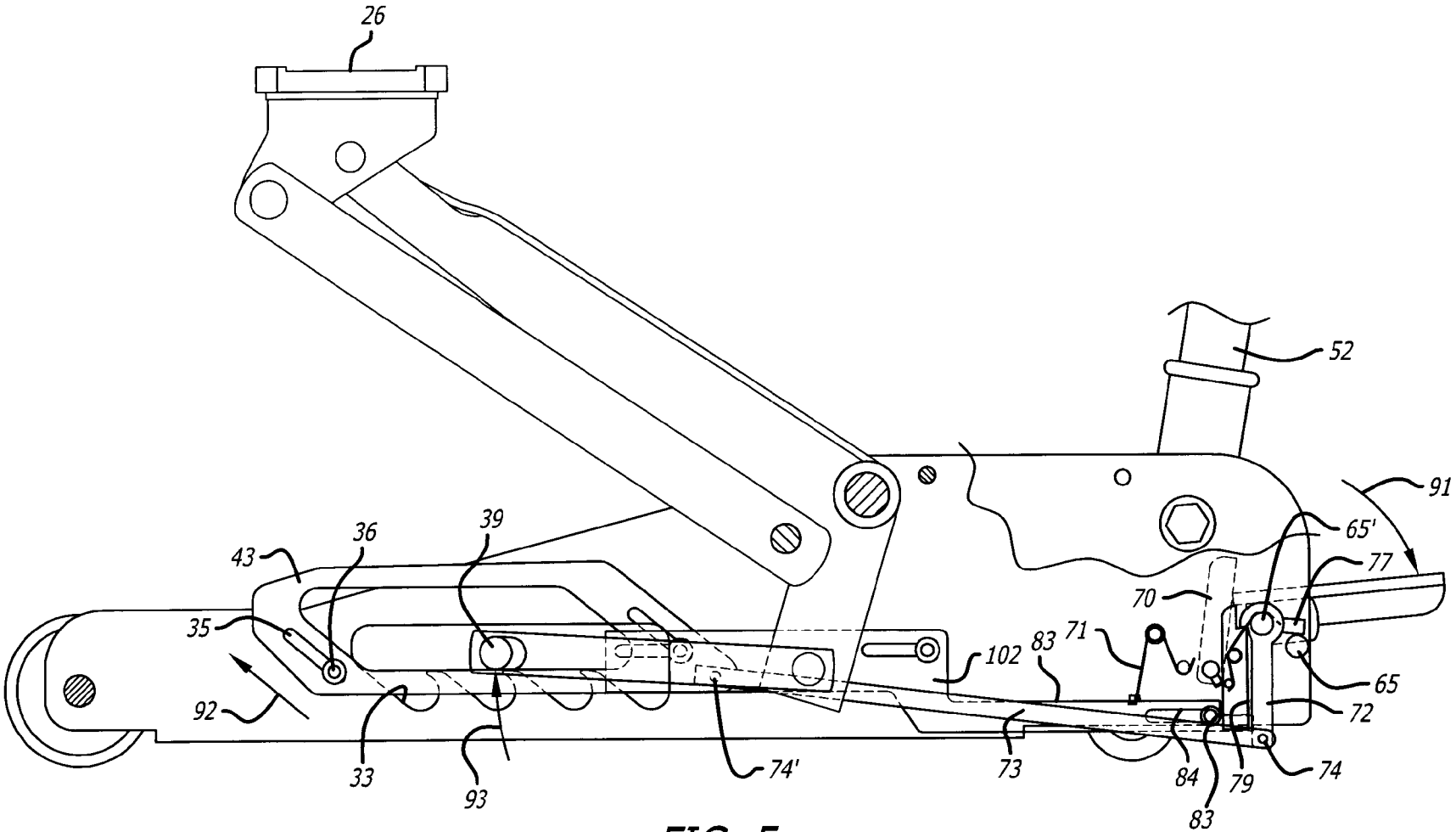

In summary, lever 64 is in the forward or stored position of FIG. 2. Saddle 26 is in the lower position shown and the jack 10 may be placed under a vehicle or the like to lift the same. Handle 52 is now rotated clockwise and pumped up and down to raise saddle 26 and thus the vehicle. As the vehicle is lifted, rollers 39 move along grooves 33, thus preventing a quick full downward drop of jack 10 should a malfunction of the power unit take place. Rollers 39 thus move forwardly into a forward groove as shown in FIGS. 3 to 5.

When it is desired to lower jack 10, the operator merely taps lever 64 with his or her foot moving it from the FIG. 1 position to the FIG. 4 position, then pressing it downwardly to lift plates 43 as heretofore discussed this lifting rollers 39 out of grooves 33. Handle 52 is now rotated counterclockwise lowering jack 10 to the FIG. 2 position.

Although a particular embodiment of the invention is discussed, variations thereof may occur to an artisan and the scope of the invention should only be limited by the scope of the appended claims.

We claim:

1. A hydraulic jack comprising:

a saddle mounted on a frame movable from a first lowered position to a second lifted position;

hydraulic power means on the frame engaging said saddle adapted to raise and lower the same when actuated;

lowering control means on said frame for controlling the descent of said saddle during lifting of the same in case of failure or malfunction of said power means during raising of said saddle, said frame including a pair of horizontally extending spaced side walls each having an upper edge and each having substantially vertical planer inside and outside walls and said lowering control means including a plurality of spaced grooves extending horizontally along at least one of the inside walls of one of said side walls of said frame below the upper edge thereof and forming an integral part of said inside wall, and at least one cylindrical roller mounted on said frame between said side walls directly engaging said spaced grooves and movable horizontally along said spaced grooves in a rolling motion when said saddle is raised to a lifted position; and release means engaging said lowering control means for releasing the same when said saddle is in a raised position, said release means including a pivotally mounted lever movable from a first stored position disengaged from said lowering control means to a second position engaging said lower control means to release the same.

2. The jack of claim 1 wherein said lowering control means includes at least one guide plate mounted on said frame, said at least one roller movable along and guided by said guide plate when said saddle is raised to a lifted position.

3. The jack of claim 2 wherein said lowering control means includes linkage means mounted on said frame coupled to said at least one guide plate, said linkage means being coupled to release means engaging the lowering control means for releasing the same when said saddle is in a raised position.

4. The jack of claim 3 wherein said release means includes a pivotally mounted lever movable from a first stored position disengaged from said lowering control means to a second position engaging said lowering control means to release the same.

5. The jack of claim 4 wherein said linkage means includes an extension portion pivotally connected at one end to said at least one guide plate and at the other end to said release means whereby movement of said release means moves said at least one guide plate linearly with respect to said frame, and lowering control means includes a guide plate release plate coupled thereto having an extension portion engagable by said release means when said saddle is in its raised position to raise said at least one guide plate, thereby raising said at least one roller out of its respective groove.

6. The jack of claim 5 wherein a pair of said guide plates, a pair of said rollers, and a pair of said grooves are provided, one of each said grooves being provided integrally on one of each of said inner walls of each of said side walls, and one of each said guide plates being disposed adjacent one of each of said side walls having an opening therethrough coinciding with the respective grooves integral with each of said inner walls of each of said side walls, and one of said rollers extending into one of the respective spaced grooves in said spaced side walls.

7. The jack of claim 1 including an elongated handle coupled to said hydraulic power means adapted to raise said saddle when rotated axially in one first direction and subsequently pumped up and down, and adapted to lower said saddle when rotated axially in a direction opposite said first direction and subsequently pumped up and down upon release of said release means.

* * * * *